US006698768B2

(12) United States Patent
Chun-Cheng et al.

(10) Patent No.: US 6,698,768 B2
(45) Date of Patent: Mar. 2, 2004

(54) SPORTS SHOE HAVING A DETACHABLE ICE/ROLLER SKATE

(75) Inventors: Chang Chun-Cheng, No. 492-16, Chia Li Hsing, Chia-Li Town, Tainan Hsien (TW); Chiu Hong-Young, Tainan Hsien (TW)

(73) Assignee: Chang Chun-Cheng, Tainan Hsien (TW)

( * ) Notice: Subject to any disclaimer, the term of this patent is extended or adjusted under 35 U.S.C. 154(b) by 1 day.

(21) Appl. No.: 10/035,160

(22) Filed: Jan. 4, 2002

(65) Prior Publication Data

US 2003/0127830 A1 Jul. 10, 2003

(51) Int. Cl.[7] ..... A63C 17/00; A63C 17/18
(52) U.S. Cl. ..... 280/11.19; 280/7.13
(58) Field of Search ..... 280/7.12, 7.13, 280/7.14, 8, 11.19, 11.221, 11.223, 11.224, 11.27

(56) References Cited

U.S. PATENT DOCUMENTS

| | | | | | |
|---|---|---|---|---|---|
| 2,998,260 | A | | 8/1961 | Meyer | |
| 3,281,971 | A | * | 11/1966 | Weitzner | 280/7.13 |
| 3,526,976 | A | * | 9/1970 | Jacobs | 280/7.13 |
| 4,146,241 | A | * | 3/1979 | Stevenson | 280/11.27 |
| 4,150,499 | A | * | 4/1979 | Wang | 280/7.13 |
| 4,666,168 | A | | 5/1987 | Hamill et al. | |
| 4,932,675 | A | * | 6/1990 | Olson et al. | 280/7.13 |
| 5,314,199 | A | | 5/1994 | Olson et al. | |
| 5,340,132 | A | | 8/1994 | Malewicz | |
| 5,507,506 | A | | 4/1996 | Shadroui | |
| 5,513,862 | A | * | 5/1996 | Chuang | 280/11.27 |
| 5,662,338 | A | | 9/1997 | Steinhauser, Jr. | |
| 6,120,038 | A | | 9/2000 | Dong et al. | |
| 6,135,463 | A | * | 10/2000 | Wrike | 280/7.13 |

FOREIGN PATENT DOCUMENTS

| | | | | |
|---|---|---|---|---|
| WO | 93/07938 | * | 4/1993 | 280/7.13 |

OTHER PUBLICATIONS

"Inside the Switchit Interchangeable Skate" Nov. 1991, Popular Mechanics, p. 50.*

* cited by examiner

*Primary Examiner*—Frank Vanaman
(74) *Attorney, Agent, or Firm*—Bacon & Thomas, PLLC

(57) ABSTRACT

The sports shoe mainly comprises a pivot, a blocking plate and a latch. The pivot is adapted to pivotally connect the sports shoes to a detachable ice/roller skate and the latch is adapted to securely lock therebetween. The blocking plate is arranged in spaced relationship with the pivot and a space provided therebetween is adapted to receive a pivotal hook seat of the pivot. The latch includes an elastic member and a plurality of guiding studs which are used to increase the sports shoe in assembled reliability for operating the detachable ice/roller skate.

11 Claims, 8 Drawing Sheets

SPORTS SHOE HAVING A DETACHABLE ICE/ROLLER SKATE

BACKGROUND OF THE INVENTION

1. Field of the Invention

The present invention is related to a sports shoe having a detachable ice/roller skate and more particularly to an ice/roller skate which utilizes a locking member and a pivotal member detachably connected to the sports shoe to insure assembled reliability.

2. Description of the Related Art

The technology trend in skates manufacturing has been toward a convertible shoe with a detachable ice/roller skate. Attaching the detachable ice/roller skate to the convertible shoe to produce an ice/roller skate which is capable of converting from a shoe into an ice/roller skate at will is known in the art. Also, detaching the detachable ice/roller skate from such a convertible ice/roller skate to convert it into a shoe for walking is known in the art. Thus, a skater can avoid carrying additional footwear for walking or other physical activity when the skates are not in use or are not allowed. A need exists for improving the construction of convertible shoes and facilitating their operation. Currently, with increasing demand for assembled reliability, convertible shoes have evolved over the years.

U.S. Pat. No. 2,998,260, issued on Aug. 29, 1961 to Meyer, discloses a skate shoe and interchangeable roller and ice skates therefor. The skate shoe includes the combination of a mounting plate secured beneath the sole of the shoe. This mounting plate is provided with a plurality of headed studs and a lug. A skate has a top plate matching the mounting plate having a plurality of keyhole slots and a locking slot. The keyhole slots are capable of receiving the headed studs when the shoe is placed upon the skate for retaining the shoe assembled with the skate. The lug is capable of being inserted into the locking slot so that a screw mount lug and a locking screw thereof is adjusted to abut against the lug to effectively lock the shoe in place upon the top plate of the skate.

U.S. Pat. No. 6,120,038, issued on Sep. 19, 2000 to Dong et al., discloses a skate having a shoe portion detachably secured to a plurality of longitudinally aligned skate wheels for traversing a surface. The shoe portion has a sole defining a toe end and a heel end. The skate further includes a frame having an upper surface and a lower surface attached to the wheels. The skate also includes a heel latch member rotatably attached to the frame for receiving and coupling to a heel binding attachment surface located in the heel end of the sole to the frame. A lever arm is attached to the heel latch member to selectively release or attach the shoe portion from the heel latch member. The heel latch member is rotatable about a vertical axis extending normal to the elongate direction of the frame. The heel latch member is rotatable between a locked position, wherein the heel attachment member is nested therein, and an open position, wherein the frame is detachable from the shoe portion to convert the skate into a conventional shoe. However, the structure of the heel latch member of U.S. Pat. No. 6,120,038 requires a complicated manufacturing process which increases the mass production cost. Meanwhile, a C-shaped hook portion of U.S. Pat. No. 6,120,038 is singular member that reduces assembled reliability of the shoe.

A variety of other roller skates are particularly disclosed in U.S. Pat. Nos. 5,314,199; 5,340,132; 5,507,506; and 6,164,669.

The present invention intends to provide a pivotal rod seat and a blocking plate, and a space structurally defined therebetween for pivotally receiving a pivotal hook seat that enhances the entire assembled relationship between a sports shoe and an ice/roller skate. The sports shoe in accordance with the present invention confines the aforementioned space by providing the blocking plate for more assembled reliability in such a way to mitigate and overcome the above problem.

SUMMARY OF THE INVENTION

The primary objective of this invention is to provide a sports shoe having a detachable ice/roller skate, which comprising a blocking plate which is adapted to structurally confine the engagement of the sports shoe with the skate in an angular range that increases assembled reliability.

The secondary objective of this invention is to provide the sports shoe having the detachable ice/roller skate, which includes a latch means with a guiding stud for strengthening engagement of the sports shoe with the skate that increases lock and assembled reliability.

The another objective of this invention is to provide the sports shoe having the detachable ice/roller skate including a latch means with an elastic member that can enhance lock/release operating.

The present invention is a sports shoe having a detachable ice/roller skate. The sports shoe mainly comprises a pivotal means, a blocking plate and a latch means. The pivotal means is adapted to pivotally connect the sports shoes to a detachable ice/roller skate and the latch means is adapted to securely lock therebetween. The blocking plate is arranged in spaced relationship with the pivotal means and a space provided therebetween is adapted to receive a pivotal hook seat of the pivotal means. The latch means includes an elastic member and a plurality of guiding studs which are used to increase reliability of the assembled sports shoe in its operation of the detachable ice/roller skate.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
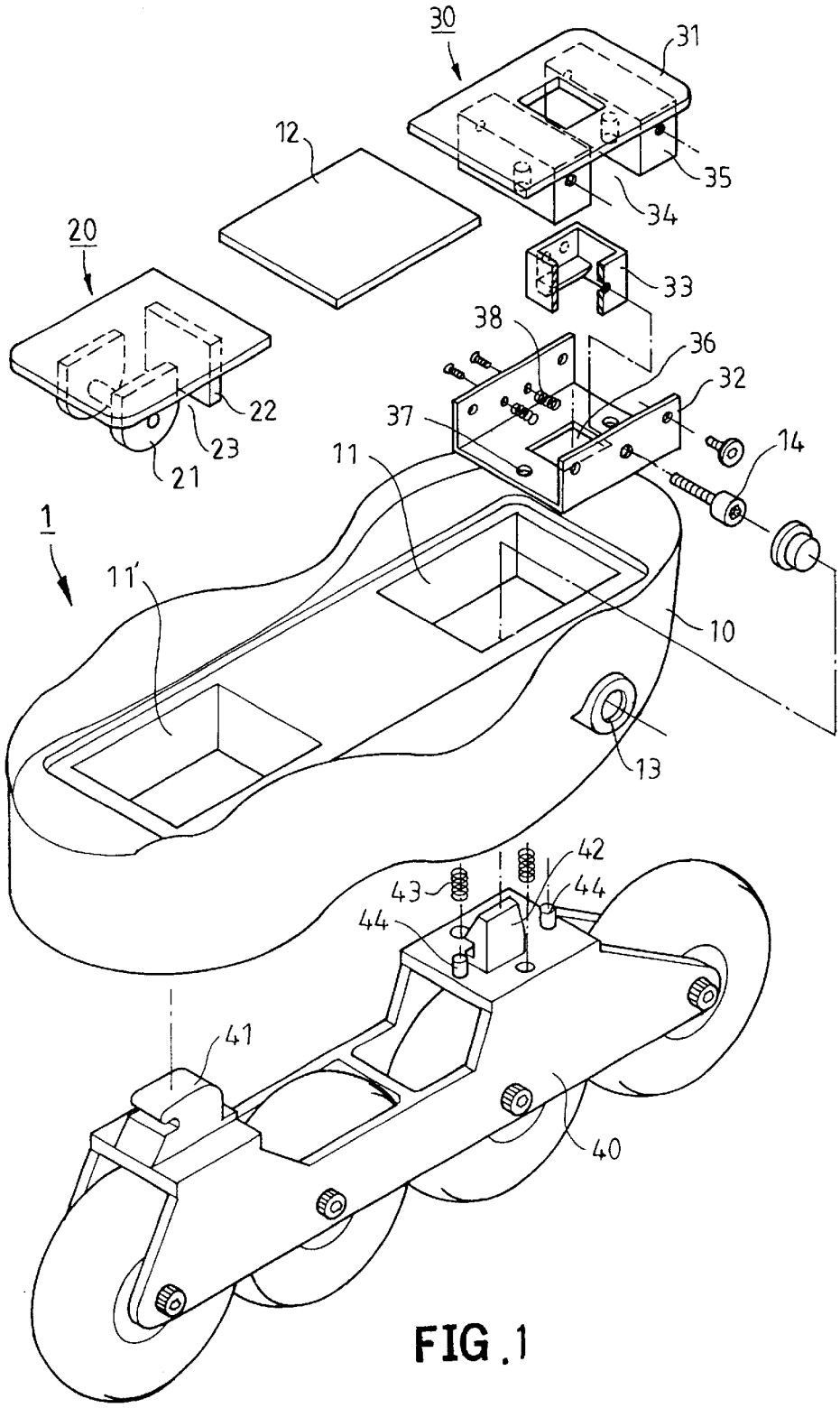
FIG. 1 is an exploded perspective view of the sports shoe having a roller skate in accordance with a first embodiment of the present invention.
Figure 2:
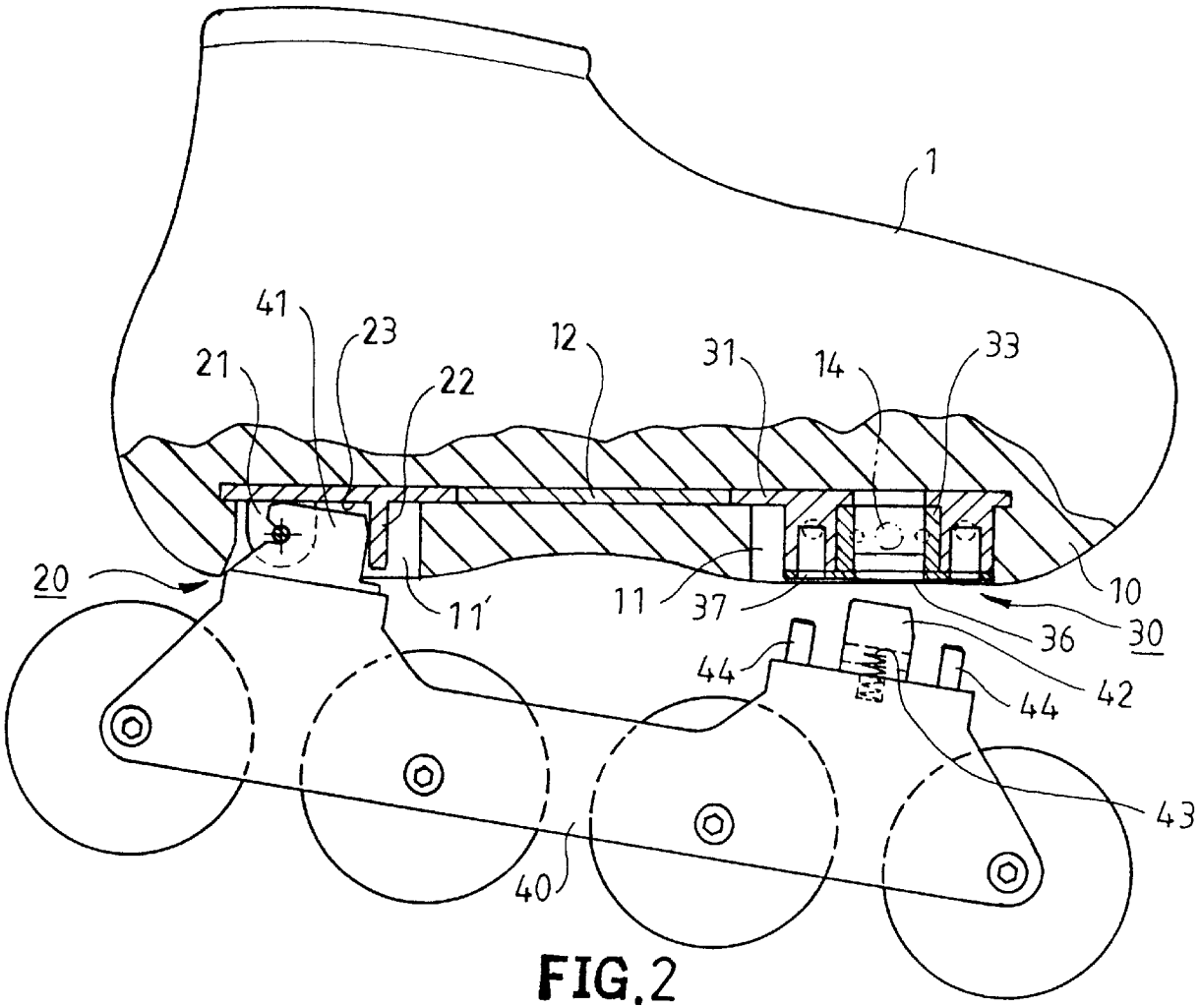
FIG. 2 is a partial cross-sectional view of the sports shoe having the roller skate in a confined position in accordance with the first embodiment of the present invention.

Referring now to the drawings, there are four embodiments of the present invention shown therein, which include generally a primary sports shoe member and a secondary roller/ice skate member.

Referring initially to FIGS. 1 through 5, a sports shoe 1 in accordance with the first embodiment of the present invention generally includes a sole designated as numeral 10, a pivotal means designated as numeral 20, a latch means designated as numeral 30 and a roller skate designated as numeral 40. Much of the detailed internal structure of the sports shoe 1 is omitted. The sole 10 comprises two cavities 11 and 11' at its underside each having an appropriate opening so as to contain the pivotal means 20 and the latch means 30 respectively. A sole-pad 12 is arranged between the two cavities 11 and 11' and thus secures the pivotal means 20 and the latch means 30. The cavity 11 further provides a hole 13 connected with the outer circumference of the sole 10. A button 14 has a first end exposed on the outer circumference of the sole 10 and a second end extended into the cavity 11. In addition, the roller skate 40 is preferably an in-line roller skate and includes a pivotal member of the pivotal means 20 and a latch member of the latch means 30 on its uppermost portion.

Figure 3:
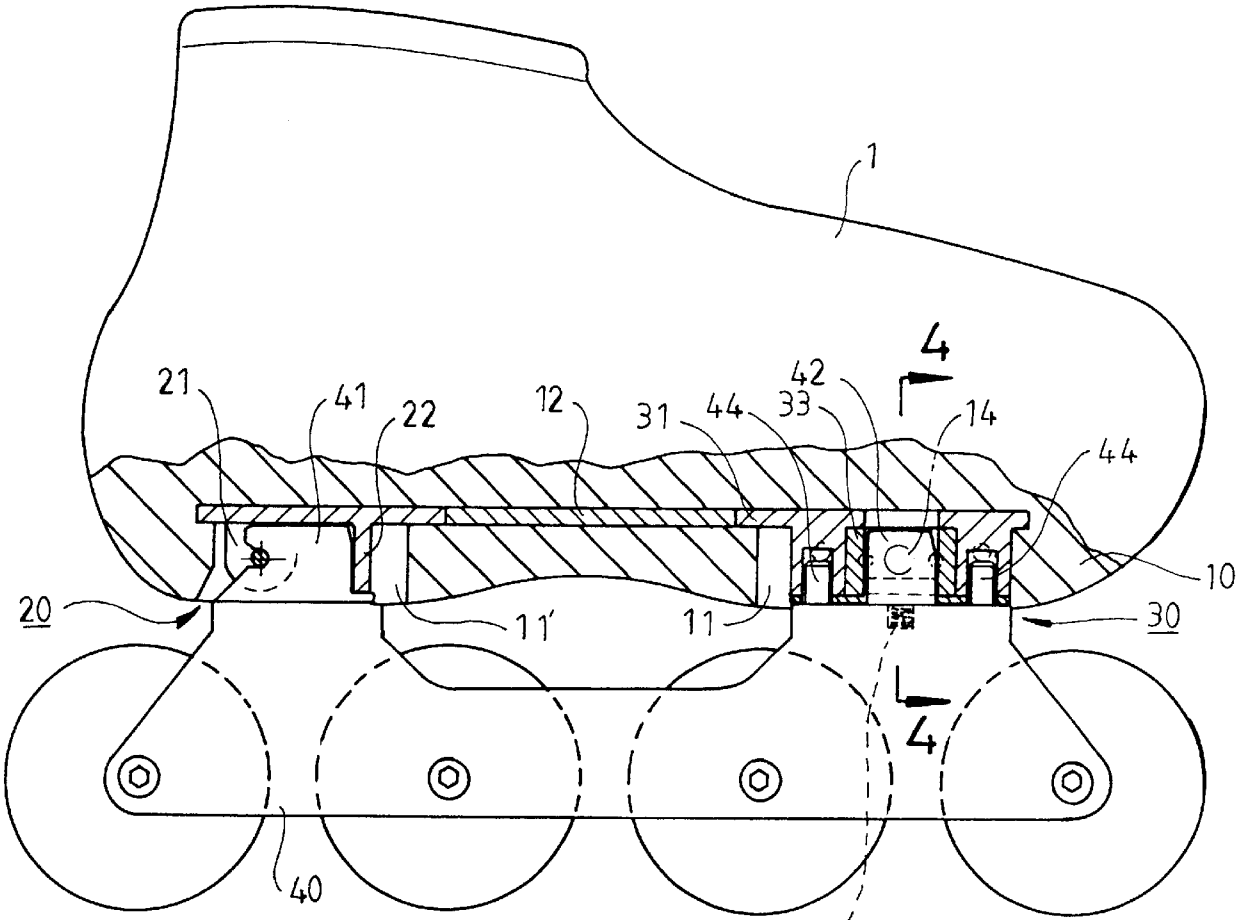
FIG. 3 is a partial cross-sectional view of the sports shoe having the roller skate in a locked position in accordance with the first embodiment of the present invention.
Figure 5:
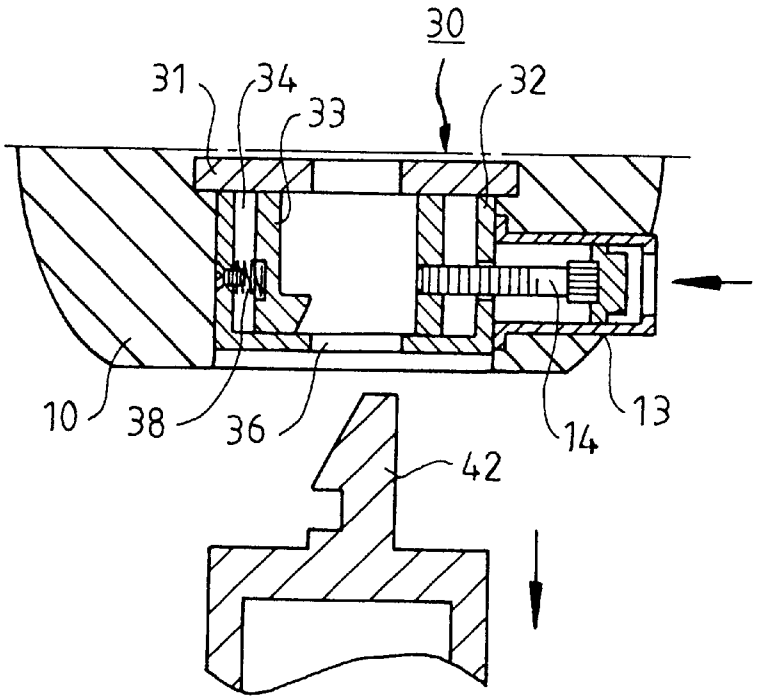
FIG. 5 is a partial cross-sectional view of the locked means in an unlocked situation similar to FIG. 4 in accordance with the first embodiment of the present invention.
Figure 4:
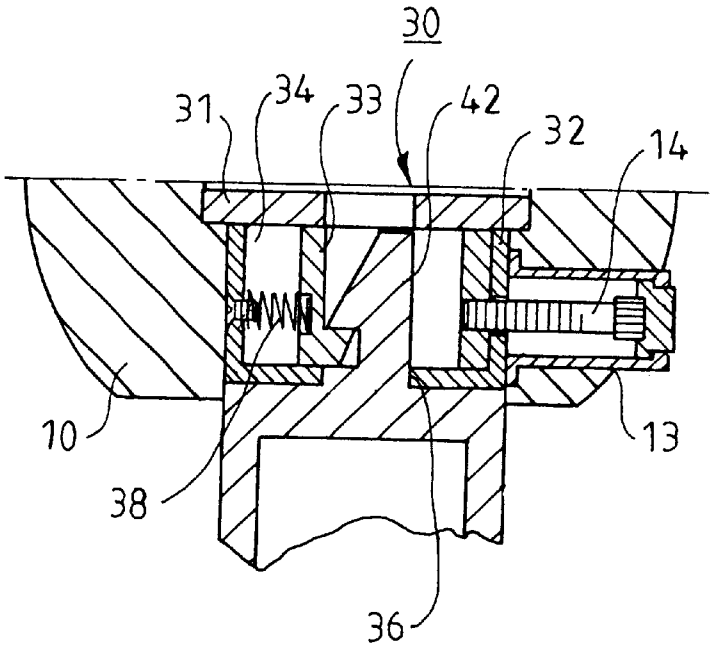
FIG. 4 is a partial cross-sectional view, taken along 4—4 in FIG. 3, of a locked means in a locked situation in accordance with the first embodiment of the present invention.

Construction of the pivotal means 20 shall be described in detail, referring now to FIGS. 1 and 3. The pivotal means 20 in accordance with a first embodiment of the present invention mainly includes a pivotal rod seat 21 and a blocking plate 22 which are mounted to the sole 10. The pivotal means 20 is projected downwardly for mounting the roller skate 40. The blocking plate 22 is arranged in spaced relationship with the pivotal rod seat 21 to define a space 23 formed therebetween. The heel end of the roller skate 40 corresponding to the pivotal means 20 has a pivotal hook seat 41 which is adapted to align with the pivotal rod seat 21 in the cavity 11'. Dimensions of the pivotal hook seat 41 are thereby adapted to fittingly insert into the space 23 between the pivotal rod seat 21 and the blocking plate 22 during initial assembly. Thus, the entire pivotal hook seat 41 may be best engaged with the pivotal rod seat 21, is confined within the space 23 and then as the roller skate 40 rotates a predetermined angle with respect to the pivotal rod seat 21 and the pivotal hook seat 41, the heel end of the roller skate 40 is connected with the heel end of the sole 10.

Construction of the latch means 30 shall be described in detail, referring now to FIGS. 1, 2, 4 and 5. The latch means 30 in accordance with the first embodiment of the present invention mainly includes a mounting seat 31, a mounting case 32 and a slide 33 which are mounted to the sole 10. The mounting seat 31, the mounting case 32 and the slide 33 are nestled in assembled relationship within the cavity 11. The mounting seat 31 comprises a guiding groove 34 defined by a pair of walls 35. The mounting case 32 further comprises a hole 36 vertically aligned with the guiding groove 34 and a pair of guiding holes 37. Meanwhile, a pair of springs 38 as well as elastic member abut against one side of the slides 33 and the button 14 is securely mounted to the other side. The slide 33 is capable of positioning at an end of the guiding groove 34 for locking the toe end of the roller skate 40 by means of the bias force of the spring 38. And also the slide 33 is capable of transversely reciprocating along the guiding groove 34 while the button 14 is pressed for releasing the toe end of the roller skate 40. Accordingly, the toe end of the roller skate 40 corresponding to the latch means 30 has a latch hook 42 being adapted to align with the mounting seat 31 and the slide 33 in the cavity 11. The latch means 30 provided on the roller skate 40 further includes a pair of elastic members 43 and a plurality of guiding studs 44 which are used to increase assembled reliability of the sports shoe 1 for operating the detachable roller skate 40.

Assembling operation of the roller skate with the sole 10 is described in three steps, referring back to FIGS. 2 and 3. In the first step, the pivotal hook seat 41 of the roller skate 40 is inserted into the space 23 and then engaged with the pivotal rod seat 21. In the second step, the roller skate 40 is rotated a predetermined angle with respect to the pivotal rod seat 21 and the guiding studs 44 are inserted into the guiding holes 37. In the third step, the latch hook 42 is completely inserted into the hole 36 of the mounting case 32 and pressed to engage with the slide 33.

The locked condition of the latch means 30 shall now be described with reference back to FIGS. 3 and 4. In the locked position, the latch hook 42 which was previously inserted into the hole 36, engages with the slide 33 which is positioned by the bias force of the spring 38 at the right side in the mounting case 32. Meanwhile, the elastic members 43 provide appropriate bias force between the mounting case 32 and the latch hook 42. The button 14 is capable of being pressed to release the latch hook 42 for detaching the roller skate 40.

Releasing operation of the latch means 30 shall now be described with reference back to FIGS. 2 and 5. In the releasing operation, the button 14 is pressed to move the slide 33 a predetermined distance along the guiding groove 34 from right to left so that the slide 33 can be disengaged with the latch hook 42. As the slide 33 moves a predetermined distance to the left side, the latch hook 42 is disengaged with the slide 33. In the released situation, the toe end of the roller skate 40 is automatically released from the sole 10 by means of the bias force of the elastic member 43.

Figure 6:
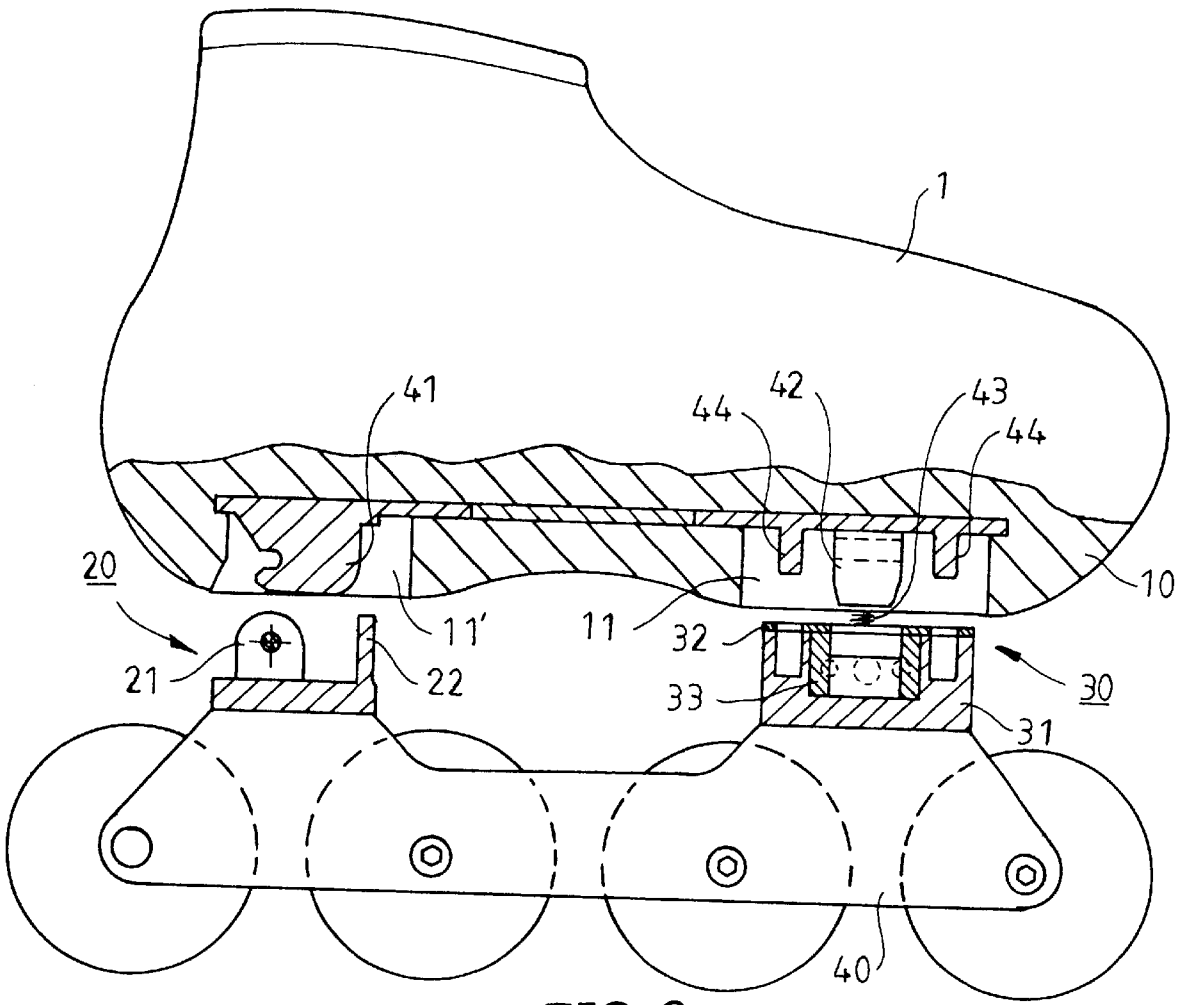
FIG. 6 is an exploded partial cross-sectional view of a sports shoe having a roller skate in detached situation in accordance with a second embodiment of the present invention.

Referring to FIG. 6, reference numerals of the second embodiment have applied the identical numerals of the first embodiment. The sports shoe 1, the sole 10, the pivotal means 20, the latch means 30 and the roller skate 40 of the second embodiment have the similar configuration and same functions as the first embodiment and the detailed descriptions are omitted. At the heel end of the sole 1, the pivotal rod seat 21 and the blocking plate 22 of the first embodiment provided on the sole 10 are interchanged with those provided on the roller skate 40 in accordance with the second embodiment. By contrast, the pivotal hook seat 41 provided on the roller skate 40 of the first embodiment is interchanged with that provided on the sole 10 in accordance with the second embodiment. At the toe end of the sole 1 the mounting seat 31, the mounting case 32 and the slide 33 of the first embodiment provided on the sole 10 are interchanged with those provided on the roller skate 40 in accordance with the second embodiment. By contrast, the latch hook 42, the elastic members 43 and the guiding studs 44 provided on the roller skate 40 of the first embodiment is interchanged with those provided on the sole 10 in accordance with the second embodiment.

Figure 7:
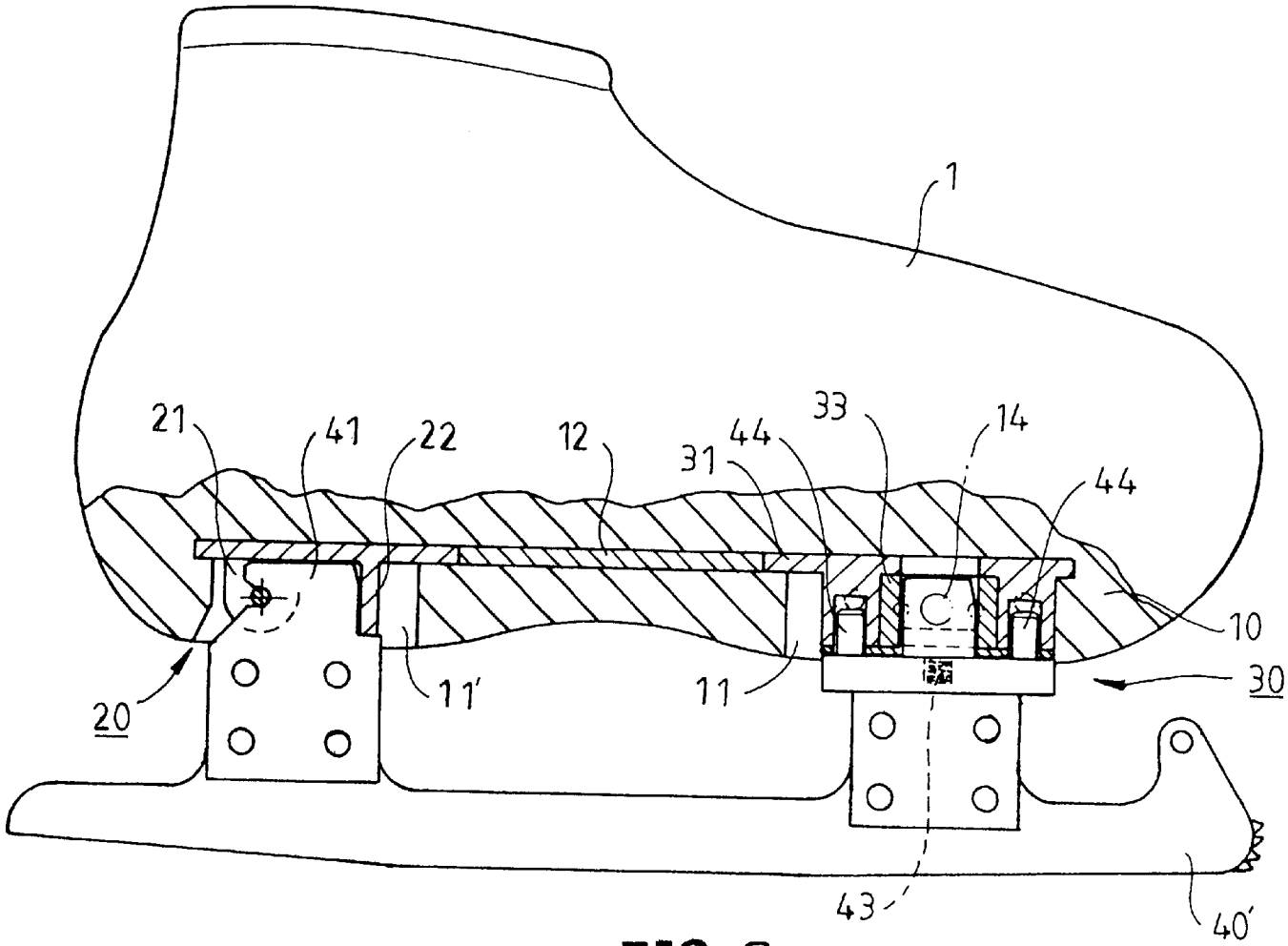
FIG. 7 is a partial cross-sectional view of a sports shoe having an ice skate in a locked situation in accordance with a third embodiment of the present invention.

Referring to FIG. 7, reference numerals of the third embodiment have applied the identical numerals of the first embodiment. The sports shoe 1, the sole 10, the pivotal means 20 and the latch means 30 of the third embodiment have the similar configuration and same functions as the first embodiment and the detailed descriptions are omitted. The roller skate 40 of the first embodiment is interchanged with an ice skate 40' in accordance with the third embodiment. The third embodiment allows interchangeability between a roller skate 40 and an ice skate 40' at will.

Figure 8:
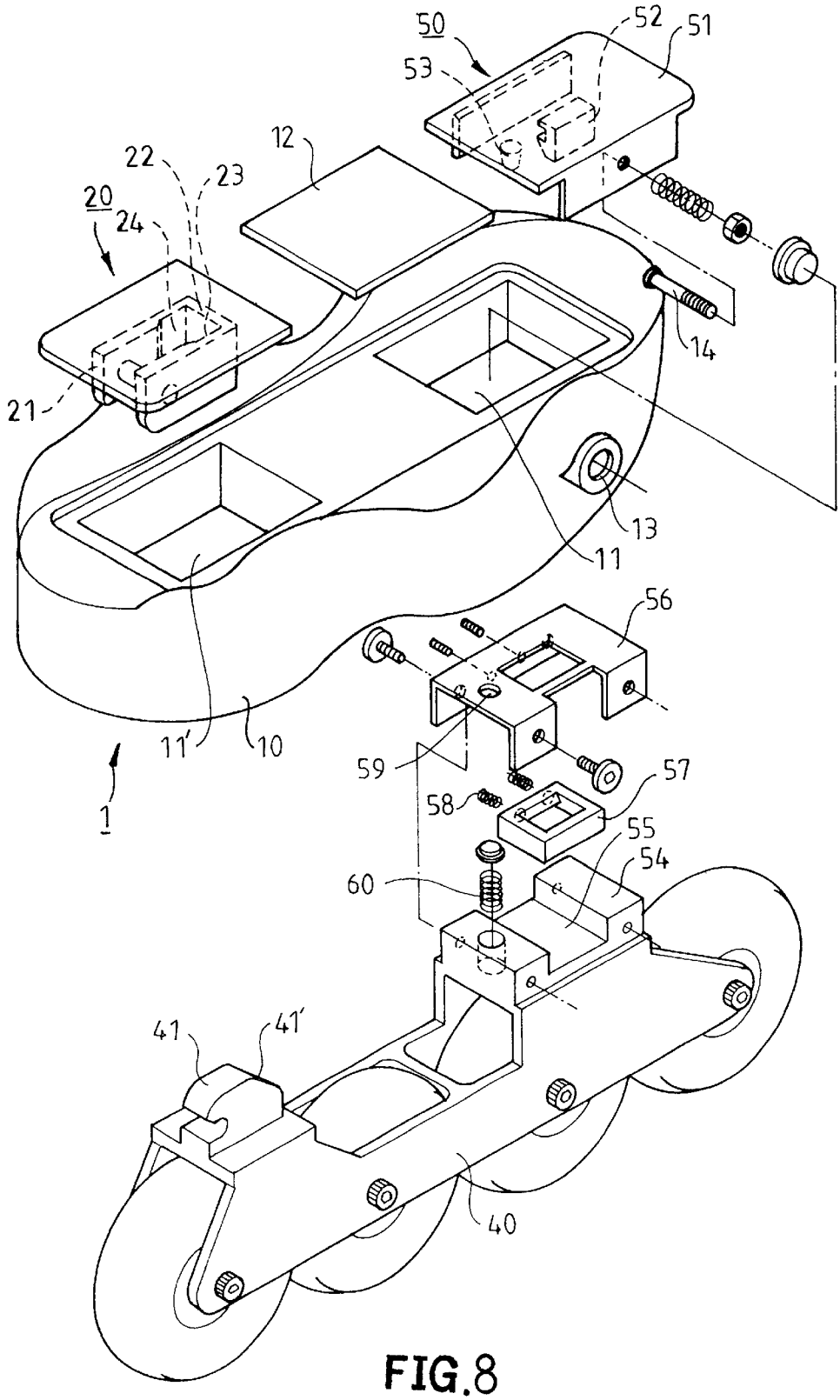
FIG. 8 is an exploded perspective view of the sports shoe having a roller skate in accordance with a fourth embodiment of the present invention.
Figure 9:
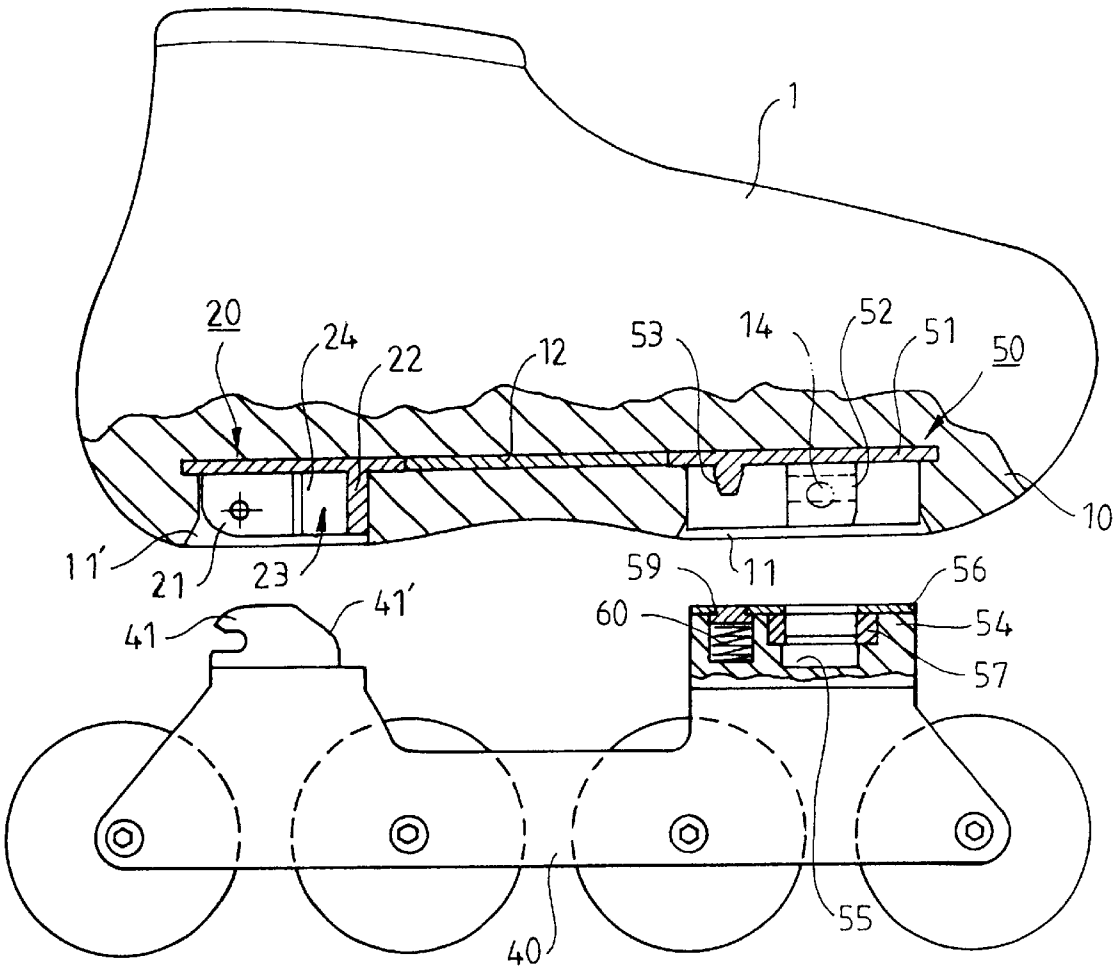
FIG. 9 is a partial cross-sectional view of the sports shoe having the roller skate in a detached situation in accordance with the fourth embodiment of the present invention.

Referring to FIGS. 8 and 9, reference numerals of the fourth embodiment have applied the identical numerals of the first embodiment. The sports shoe 1, the sole 10, the pivotal means 20, the latch means 50 and the roller skate 40 of the fourth embodiment have the similar configuration and same functions as the first embodiment and the detailed descriptions are omitted. The pivotal means 20 in accordance with a fourth embodiment of the present invention further includes two curved walls 24 which are mounted to the sole 11 and which extend from the pivotal rod seat 21 to the blocking plate 22. As has been described in the first embodiment, the heel end of roller skate 40 also has a pivotal hook seat 41 corresponding to the pivotal means 20. The two curved walls 24 are expanded symmetrically along a centerline and have a corresponding dimension slightly greater than that of the pivotal hook seat 41. During the assembling operation, the curved wall 24 is adapted to facilitate the insertion of the pivotal hook seat 41 into the pivotal rod seat 21. The pivotal hook seat 41 further includes an inclined surface 41' provided on its top end opposite to a hook opening and thus can be conveniently inserted into the space 23. The inclined surface 41' is also adapted to facilitate passing the pivotal hook seat 41 along a top of the blocking plate 22 while assembling or disassembling.

Construction of the latch means 50 in accordance with the fourth embodiment shall be described in detail, still referring to FIGS. 8 and 9. The latch means 50 mainly includes a mounting seat 51, a latch hook 52 and a guiding stud 53 which are mounted to the sole 10. The roller skate 40 provides a pair of walls 54 and a guiding groove 55 on its uppermost corresponding to the latch means 50. A mounting case 56 and a slide 57 are nestled in assembled relationship on the guiding groove 52. The slide 57 is capable of being positioned at and end of the guiding groove 55 by means of the bias force of a pair of springs 58 for locking the toe end of the roller skate 40 with the latch hook 52 in the cavity 11. And also the slide 57 is capable of reciprocating along the guiding groove 55 while the button 14 is pressed for releasing the toe end of the roller skate 40 from the latch hook 52. The mounting case 56 further includes a guiding hole 59 and an elastic member 60 thereof being adapted to receive and bias the guiding stud 53 for facilitating in the assembling and releasing operations.

The assembling operation of the roller skate with the sole 10 is also described in three steps, still referring to FIG. 9. In first step, the inclined surface 41' of the roller skate 40 is passed on a top of the blocking plate 22 so that the pivotal hook seat 41 is easily inserted into the space 23 and is then engaged with the pivotal rod seat 21 along the curved wall 24. In the second step, the roller skate 40 is rotated a predetermined angle with respect to the pivotal rod seat 21 and the guiding stud 53 is initially inserted into the hole 59. In the third step, the latch hook 52 is completely inserted into a hole of the mounting case 56 and pressed to engage with the slide 57. The guiding stud 53 is eventually positioned against the elastic member 60 in the hole 59.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat mounted to the sole in the second cavity;

a mounting case mounted to the sole on the mounting seat and provided with a hole;

a slide sandwiched in between the mounting seat and the mounting case such that the mounting seat, the mounting case and the slide are nestled in assembled relationship within the second cavity, with the proviso that the slide is received in a guiding groove of the mounting seat and capable of being positioned at an end of the guiding groove and also capable of reciprocating along the guiding groove; and a latch hook provided on the skate and being adapted to align with the mounting seat and engage with the slide through the hole of the mounting case in the second cavity.

2. The sports shoe as defined in claim 1, wherein the slide is capable of reciprocating along the guiding groove by means of an elastic member and a button.

3. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat mounted to the sole in the second cavity;

a mounting case mounted to the sole on the mounting seat and provided with a hole;

a slide sandwiched in between the mounting seat and the mounting case such that the mounting seat, the mounting case and the slide are nestled in assembled relationship within the second cavity; and a latch hook provided on the skate and being adapted to align with the mounting seat and engage with the slide through the hole of the mounting case in the second cavity;

with the proviso that the mounting case of the latch means further comprises a guiding hole being adapted to receive a guiding stud of the skate for facilitating in releasing operation.

4. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat mounted to the sole in the second cavity;

a mounting case mounted to the sole on the mounting seat and provided with a hole;

a slide sandwiched in between the mounting seat and the mounting case such that the mounting seat, the mounting case and the slide are nestled in assembled relationship within the second cavity;

a latch hook provided on the skate and being adapted to align with the mounting seat and engage with the slide through the hole of the mounting case in the second cavity; and an elastic member provided on the skate, the elastic member being adapted to bias the sole for facilitating in releasing operation.

5. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat provided on the skate;

a mounting case mounted to the skate on the mounting seat and provided with a hole;

a slide sandwiched in between the mounting seat and the mounting case such that the mounting seat, the mounting case and the slide are nestled in assembled relationship on the skate, with the proviso that the slide is received in a guiding groove of the mounting seat and capable of being positioned at the end of the guiding groove and also capable of reciprocating along the guiding groove; and a latch hook mounted to the sole in the second cavity and being adapted to align with the mounting seat and engage with the slide through the hole of the mounting case in the second cavity.

6. The sports shoe as defined in claim 5, wherein the slide is capable of reciprocating along the guiding groove by means of an elastic member and a button.

7. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat provided on the skate;

a mounting case mounted to the skate on the mounting seat and provided with a hole;

a slide sandwiched in between the mounting seat and the mounting case such that the mounting seat, the mounting case and the slide are nestled in assembled relationship on the skate; and a latch hook mounted to the sole in the second cavity and being adapted to align with the mounting seat and engage with the slide through the hole of the mounting case in the second cavity;

with the proviso that the mounting case of the latch means further comprises a guiding hole being adapted to receive a guiding stud of the skate for facilitating in assembling operation.

8. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat provided on the skate;

a mounting case mounted to the skate on the mounting seat and provided with a hole;

a slide sandwiched in between the mounting seat and the mounting case such that the mounting seat, the mounting case and the slide are nestled in assembled relationship on the skate;

a latch hook mounted to the sole in the second cavity and being adapted to align with the mounting seat and engage with the slide through the hole of the mounting case in the second cavity; and an elastic member provided on the skate and being adapted to bias the sole for facilitating in releasing operation.

9. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat mounted to the sole in the second cavity;

a mounting case mounted to the skate, said mounting case being provided with a hole;

a slide positioned in the mounting seat such that the mounting seat, the mounting case and the slide are nestled in assembled relationship on the skate, with the proviso that the slide is received in a guiding groove of the skate and capable of being positioned at an end of the guiding groove and also capable of reciprocating along the guiding groove; and a latch hook mounted to the sole in the second cavity and being adapted to align with the mounting seat and engage with the slide through the hole of the mounting case in the second cavity.

10. The sports shoe as defined in claim 9, wherein the slide is capable of reciprocating along the guiding groove by means of an elastic member and a button.

11. A sports shoe including:

a sole having a first cavity and a second cavity at its underside;

a pivotal means provided in the first cavity and being adapted to pivotally connect the sports shoe to a skate;

a blocking plate arranged in spaced relationship with the pivotal means and a space formed therebetween for receiving a pivotal hook of the pivotal means; and a latch means provided in the second cavity and being adapted to securely lock the sports shoe to the skate wherein the latch means includes:

a mounting seat mounted to the sole in the second cavity;

a mounting case mounted to the skate, said mounting case being provided with a hole;

a slide positioned in the mounting seat such that the mounting seat, the mounting case and the slide are nestled in assembled relationship on the skate; and a latch hook mounted to the sole in the second cavity and being adapted to align with the mounting seat and engage with the slide through the hole of the mounting case in the second cavity;

with the proviso that the mounting case further includes a guiding hole and an elastic member thereof being adapted to receive and bias a guiding stud of the sole for facilitating in assembling and releasing operation.

* * * * *